United States Patent [19]

Audet

[11] 4,378,663

[45] Apr. 5, 1983

[54] STRUCTURAL PANEL

[76] Inventor: Gordon A. Audet, 1139 Rosalind, Rialto, Calif. 92376

[21] Appl. No.: 200,992

[22] Filed: Oct. 27, 1980

[51] Int. Cl.[3] ..... E04C 1/10

[52] U.S. Cl. ..... 52/580; 52/785; 52/822

[58] Field of Search ..... 52/580, 793, 807, 785, 52/822, 271, 690, 826

[56] References Cited

U.S. PATENT DOCUMENTS

| | | | |
|---|---|---|---|
| 2,362,162 | 11/1944 | Sheldon | 52/271 X |
| 2,766,488 | 10/1956 | Danielson | 52/580 |
| 3,293,820 | 12/1966 | Smith | 52/807 X |
| 3,699,736 | 10/1972 | Wallace | 52/580 X |
| 3,992,829 | 11/1976 | Schellberg et al. | 52/580 X |
| 4,187,655 | 2/1980 | Anderson | 52/580 X |

*Primary Examiner*—Price C. Faw, Jr.
*Assistant Examiner*—Carl D. Friedman
*Attorney, Agent, or Firm*—Herbert E. Kidder

[57] ABSTRACT

A prefabricated structural panel for use in constructing the walls and/or roof of a building, which comprises two laterally spaced, longitudinal rails, preferably of pressure-treated wood, each of which has a lengthwise extending channel formed in the side facing the other rail, the channel preferably having sides that converge toward the bottom; and each rail also having narrow slots formed therein along the top edges of the channel sides. Each of the longitudinal rails has a stepped configuration on the side opposite the channel, which interlock with a companionate stepped configuration of the rail on the next-adjacent panel. A plurality of ribs extends perpendicularly between the rails, and their ends are shaped to fit snugly down into the channels. On opposite sides of the ribs are panels of sheet material such as plywood, plastic laminate, sheet metal, fiberglass reinforced plastic and the like, the edges of which fit snugly into the slots. A plurality of battens is provided on opposite sides of the panel, each batten bearing against the outer surface of the sheet material directly over one of the ribs. A plurality of fasteners joins the assembly together, some of the fasteners being driven through the sheet material into the rails and into the ribs, and others being driven through the rails into the ribs, others being driven through the battens and sheet material into the ribs, and still others being driven through the rails into the rails of the next-adjacent panels.

1 Claim, 10 Drawing Figures

STRUCTURAL PANEL

BACKGROUND OF THE INVENTION

The present invention pertains to a prefabricated structural panel of the type that can be used for on-site construction of a building, and which is so constructed and arranged that it is possible, with relatively little unskilled labor, to quickly and easily erect the walls and roof of a building.

At the present time, there are only two methods commonly used to build dwellings: (1) conventional carpentry, in which raw lumber is cut to length and nailed up, piece by piece; and (2) prefabricated construction, in which factory-made components are shipped to the building site, where they are assembled to form one of a limited number of building designs. The disadvantages of the conventional method are that it is extremely slow, requiring many months to complete even the simplest dwelling; it requires many hundreds of man-hours of skilled labor, and therefore is expensive; and it is subject to long delays because of inclement weather. The disadvantages of prefabricated construction are that it is relatively inflexible, and can be used economically for only a limited range of building designs. Any contemplated change in the building design usually presents virtually insurmountable problems, as all of the components are specifically fabricated to cooperate with other specifically designed components. Thus, the building contractor is constrained to build one of a limited number of building designs, with no provision for modifying the design to accommodate the needs of the individual for whom the building is being constructed.

SUMMARY OF THE INVENTION

The primary object of the present invention is to provide a new and improved structural panel that can be fabricated by machine in a factory under rigid quality control, so that a uniform, light-weight and dimensionally accurate panel is produced, which is then shipped to the building site where assembly can be quickly and easily done by relatively unskilled labor. The structural panel of the present invention provides such a time-saving method of construction that, when combined with a factory-built core containing the bathrooms, kitchen, with all the plumbing, electrical work for the house except for room outlets, hot water system, heating and cooling system, and controls, the average house can be erected in a matter of days instead of months, at a huge saving in labor cost and construction loan interest. Since skilled labor represents more than half the cost of an average dwelling, this means that the cost of building a home can be greatly reduced.

One of the important advantageous features of the present invention is its design flexibility, which allows the architect or designer a wide range of designs, without the restrictions that are inherent in prefabricated houses. The panels can be made in varying lengths, widths and thickness, as needed, and a wide variety of sheet materials can be used for the interior and exterior surfaces, including semi-transparent sheets of fiberglass-reinforced plastic to admit light and solar heat.

The above objects and advantages are achieved by a unique structural arrangement, comprising lengthwise extending rails of pressure-treated wood that form two opposite longitudinal edges of the panel, each rail having a lengthwise extending channel in its inner surface, and narrow slots extending along the edges of the channel. Extending perpendicularly between the rails are ribs that are preferably spaced apart 16 inches on centers, and the ends of these ribs are shaped to fit snugly down into the channels of the two rails. On opposite sides of the ribs are panels of relatively flat, structural sheet material, having edges that fit snugly down into the slots. The panels of sheet material may consist of painted sheet metal, plywood, plastic laminate, fiberglass reinforced plastic, composition board, or wire mesh with stucco or plaster. To tie the assembly together, a plurality of fasteners are driven through the rails, sheet material and ribs. Battens may be used over the outer surfaces of the sheet material directly over each of the ribs, in which case the battens are secured by fasteners which go through the battens and sheet material into the ribs. The two spaced-apart panels of sheet material cooperate with the rails and ribs to form a dead air space that provides thermal insulation and sound deadening. This construction also provides great structural strength with extremely light weight. The rails have interlocking stepped formations on the surfaces opposite the channels, and these formations interfit with mating cormations on the next adjacent panel, to which they are joined by fasteners.

Panels of specified width, thickness and length are delivered to the building site, where they are merely joined together with other panels or to structural posts and other members, preferably using air-driven staple guns. Where it is desired to join two panels together at an angle, the panels are provided with rails that are shaped to position the panels at the desired angle. Since the panels are already permanently finished on their exterior and interior surfaces, relatively little remains to be done to finish the outer shell of the building after the panels have been joined together. The simplicity of erection permits the use of unskilled and semi-skilled labor, and the rapidity of erection cuts the cost of construction time by eighty percent compared to conventional systems.

The foregoing and other objects and advantages of the invention will become apparent to those skilled in the art from the following detailed description of the preferred embodiment thereof, with reference to the accompanying drawings.

DESCRIPTION OF THE PREFERRED EMBODIMENT

Figure 1:
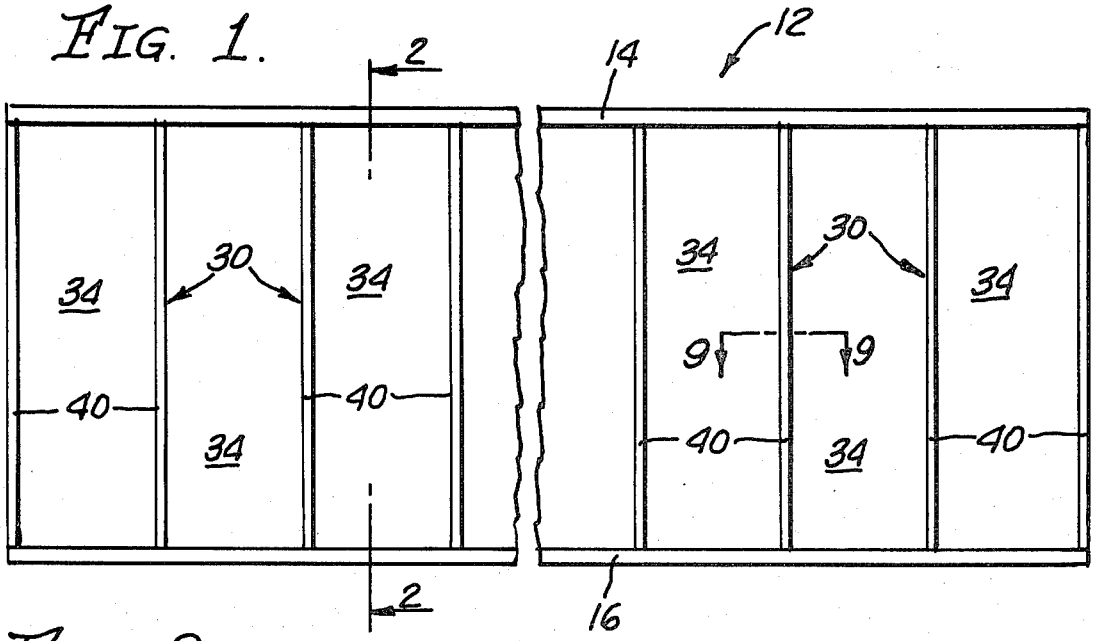
FIG. 1 is a side elevational view of a structural panel embodying the invention.

In the drawings, the structural panel of the invention is designated in its entirety by the reference numeral 12, and is herein illustrated as comprising an elongated rectangular panel, typically about sixteen feet long and approximately four feet wide. However, length, width and thickness may vary over a wide range, as called for by the building specifications, and the ends of the panel may be angled, if desired.

Forming the top and bottom horizontal edges of the panel are two spaced-apart rails 14 and 16, which are made of select structurally graded wood that has been pressure-treated to make it resistant against attack by rot or termites. Each of the rails 14, 16 has, on the surface facing toward the other rail, a shallow, lengthwise extending channel 18 (see FIG. 3), the sides 20 of which slope downwardly so that they converge toward the bottom. Laterally outward of the upper edges of the sloping side walls 20, the surfaces 22 become flat and parallel to the bottom 24 of the channel 18. At the junction of the side walls 20 with surfaces 22 are lengthwise extending narrow slots 26, the bottoms of which are approximately at the plane of the channel bottom 24. The slots 26 are typically about 1/16 inch wide and ½ inch deep, although these dimensions are not critical and may vary considerably, as needed.

Figure 2:
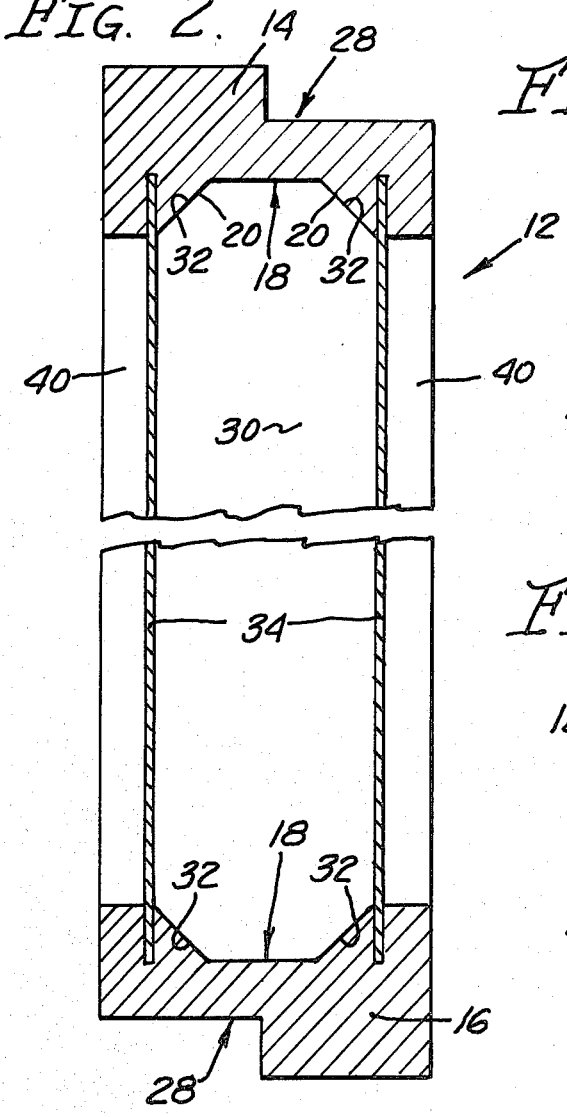
FIG. 2 is an enlarged sectional view through the same, taken at 2—2 in FIG. 1.
Figure 3:
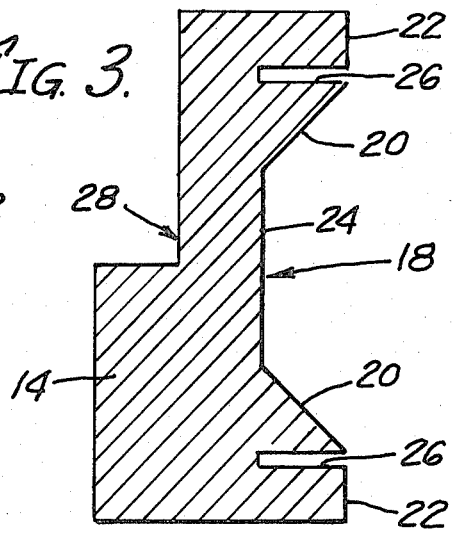
FIG. 3 is a further enlarged sectional view through one of the rails, showing details of its construction.
Figure 4:
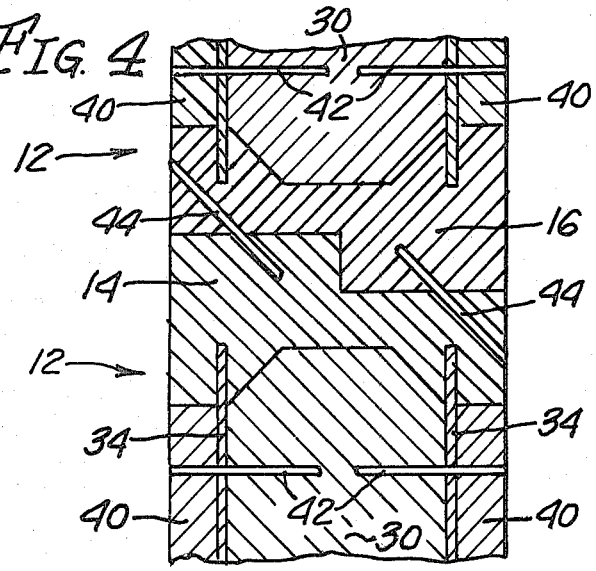
FIG. 4 is a sectional view through the rails of two adjacent panels which are joined together so that they lie in the same plane.
Figure 5:
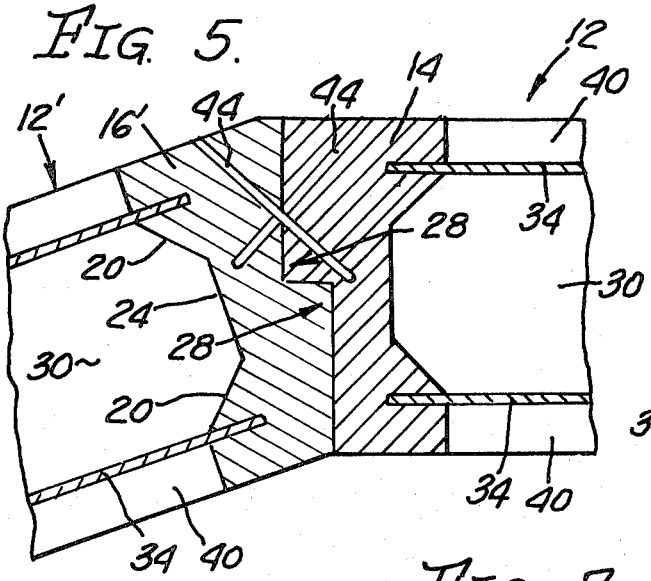
FIG. 5 is a sectional view similar to FIG. 4, but showing the rails of two panels that are joined together at an angle to one another.

On the sides of the rails 14, 16 opposite the channels 18 are stepped formations 28, which may be as shown in FIGS. 2 and 3, where two panels 12, 12, are to be joined together in a common plane (see FIG. 4), or they may be as shown in FIG. 5, where the two panels 12 and 12' are angled with respect to one another. In the case of FIGS. 2 and 4, the stepped formations 28 of the two rails 14, 16 are identical, but one of the rails has been reversed end for end, so that the stepped formations mate with respect to one another.

In the case of FIG. 5, stepped surfaces 28 of rail 14 are the same configuration as in rail 14 of FIG. 3, but rail 16' has its stepped surfaces 28' inclined at an angle to the plane of the channel bottom 24. Thus, when rail 16' is mated with rail 14, the panels 12' and 12 are disposed at an angle to one another. Other configurations of stepped surfaces may be used, depending upon the structural problem.

Extending perpendicularly between the rails 14 and 16 are ribs 30, which are preferably spaced apart 16 inches on centers. Each of the ribs 30 has its ends beveled at 32 so as to fit snugly down into the channels 18, with bevels 32 lying flat against sloping channel sides 20. The width of the ribs 30 is the same dimension as the spacing between the inner edges of slots 26.

Figure 10:
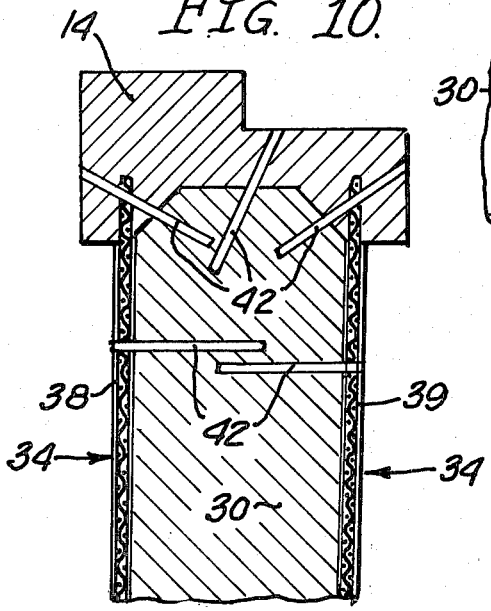
FIG. 10 is an enlarged fragmentary sectional view of an embodiment of the invention in which the sheet material consists of wire mesh with stucco on the exterior surface, and plaster on the interior surface.

Disposed on opposite sides of the ribs 30 are two panels 34 of relatively flat, structural sheet material, the top and bottom edges of which are inserted down into the slots 26 in the rails 14 and 16. The panels 34 may be of any sheet material suitable for exterior structural use, such as painted sheet metal, plastic laminate, plywood, fiberglass reinforced plastic, tempered composition board, and the like; or, as shown in FIG. 10, it may consist of wire mesh 36, with stucco 38 on the outer surface and plaster 39 on the inner surface. In all cases, the thickness dimension of the top and bottom edges of the panels 34 is such that the edges fit snugly into the slots 26.

Figure 8:
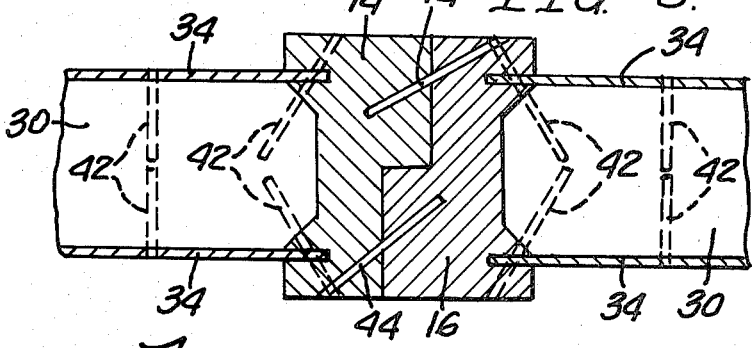
FIG. 8 is a view similar to FIG. 4, but showing a slightly modified form of the invention, in which the battens have been omitted, and the fasteners are driven directly through the sheet material into the rib.
Figure 9:
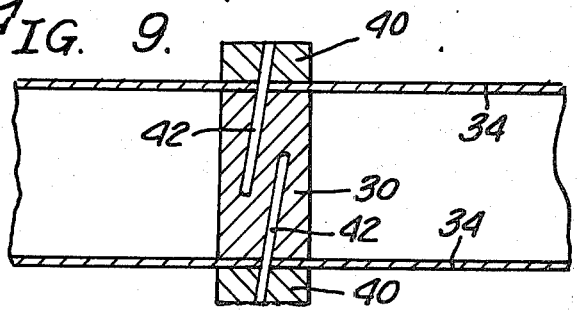
FIG. 9 is a sectional view taken at 9—9 in FIG. 7.

Preferably, the panels 12 have battens 40 overlying the panels 34 of sheet material directly over the ribs 30, as best shown in FIGS. 2 and 9. However, in some cases, the battens 40 may be omitted, as in FIGS. 6, 8 and 10.

Figure 6:
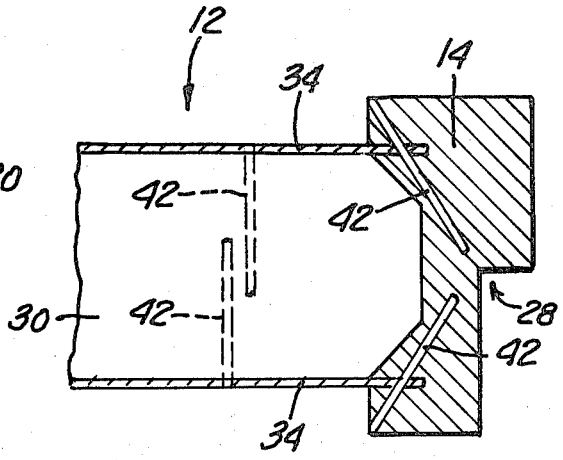
FIG. 6 is a fragmentary sectional view through one of the rails, showing how the panels of sheet material are locked to the rails by fasteners.
Figure 7:
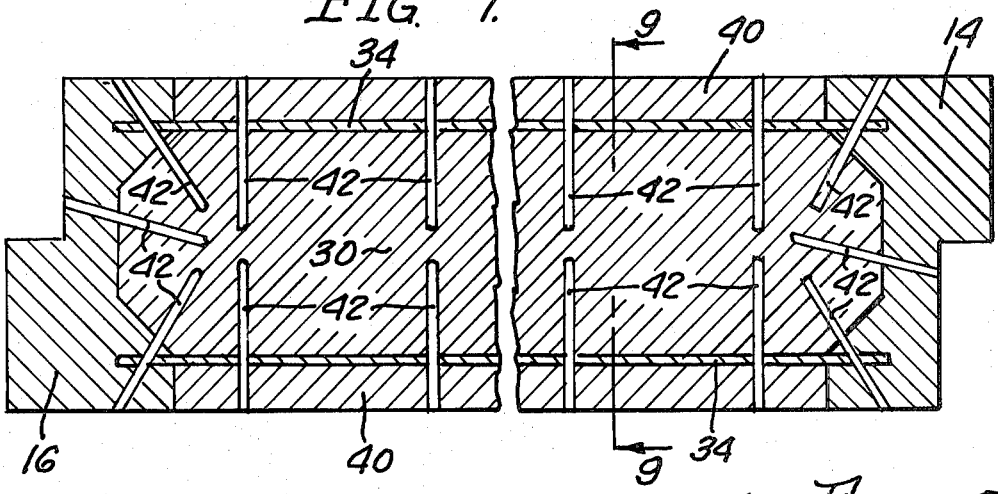
FIG. 7 is a view similar to FIG. 2, but additionally showing how fasteners are driven through the rails, sheet material, battens and ribs to tie the assembly together.

Tying the entire panel assembly together are fasteners 42, preferably heavy duty staples of the type that are driven by air-powered staple guns. Some of the staples 42 are driven diagonally into the edges of the rails so that they penetrate and pass through the edges of the panels 34, as shown in FIG. 6. Other staples 42 are driven through the sheet material 34 into the ribs 30, as shown in FIGS. 6, 8 and 10. Still other staples 42 are driven through the battens 40, sheet material 34, and into the ribs 30, as shown in FIGS. 4, 7 and 9. Those staples 42 that are driven into the ends of the ribs 30 enter the rails 14, 16 diagonally from opposite sides thereof, so that they penetrate the bottom edges of the adjacent panels 34 and also penetrate the beveled surfaces 32 of the ribs at an angle approaching the perpendicular thereto. Due to the fact that they pass through the rails 14, 16, panels 34, and ribs 30, the fasteners 42 securely lock the three elements together. At the same time, the extension of the rib 30 down into the channel 18, with its beveled surfaces 32 bearing against the sloping sides 20 of the channel provide a positive, mechanical interlock that prevents any forcible lateral displacement of the rib with respect to the rails.

At the building site, the panels 12 are assembled according to the directions of the building plan, with rails 14 of one panel mated with rails 16 of the next adjacent panel, after application of sealant on the abutting surfaces. Staples 44 are then driven through the contacting rails, as shown in FIGS. 4, 5 and 8.

The panel 12, constructed as described above, provides a light-weight, extremely rigid structure that can be speedily and easily erected, using unskilled or semi-skilled labor, and that has extreme design flexibility, allowing it to be used for almost any dwelling design. The panels 34 of sheet material cooperate with rails 14 and 16, and with ribs 30 to enclose a dead air space that provides thermal insulation as well as sound control. If the panels 34 are of fiberglass reinforced plastic, they can be left semi-transparent, so as to admit light and solar heat, or they can be made opaque. As received from the factory, the panels 12 are permanently finished on their exterior and interior surfaces, and no further painting is required.

While I have shown and described in considerable detail what I believe to be the preferred form of the invention, it will be understood by those skilled in the art that the invention is not limited to such details, but may take various other forms within the scope of the claims.

What I claim is:

1. A prefabricated structural panel for use with other like panels in the on-site construction of a building, comprising:

a pair of laterally spaced, elongated rails extending generally parallel to one another and forming two opposite longitudinal edges of the panel;

each of said rails having a lengthwise-extending channel formed in the surface facing the other rail, said channel being formed with sloping, downwardly converging sides;

a pair of lengthwise extending, narrow slots formed in said surface of each rail at the top edges of said sloping sides;

each of said rails having, on the side opposite said channel, a configuration that is adapted to interlock with a mating configuration on the rail of the next-adjacent panel;

a plurality of ribs extending perpendicularly between said rails, the ends of said ribs being beveled to fit snugly into said channels and bearing against the sloping sides thereof;

two panels of relatively flat, structural sheet material disposed on opposite sides of said ribs and having edges that fit snugly into said narrow slots;

said panels of sheet material cooperating with said rails and said ribs to enclose a dead air space between them; and a plurality of fasteners, some driven through said rails and through the edges of said panels that are seated in said narrow slots; and others driven diagonally through opposite sides of said rails so that they penetrate the adjacent panel near the bottom edge thereof and also penetrate the beveled surfaces of said rib at an angle approaching the perpendicular thereto;

the projection of said rib ends down into said channels, with said beveled surfaces bearing against the sloping sides of said channel, providing a positive, mechanical interlock that prevents any forcible lateral displacement of the rib with respect to the rails.

* * * * *